United States Patent [19]

Nielsen

[11] 4,299,068

[45] Nov. 10, 1981

[54] WINDOW LINING ARRANGEMENT, PARTICULARLY FOR INCLINED WINDOWS

[75] Inventor: Elgard Nielsen, Ostbirk, Denmark

[73] Assignee: V. Kann Rasmussen Holding A/S, Soborg, Denmark

[21] Appl. No.: 128,159

[22] Filed: Mar. 7, 1980

[30] Foreign Application Priority Data

Mar. 21, 1979 [DK] Denmark ..... 1165/79

[51] Int. Cl.[3] ..... E06B 1/04

[52] U.S. Cl. ..... 52/204; 52/584; 52/656

[58] Field of Search ..... 52/204, 217, 582, 584, 52/285, 656; 403/403, 409

[56] References Cited

U.S. PATENT DOCUMENTS 3,632,146 1/1972 Buzby ..... 52/285

3,996,718 12/1976 Welch ..... 52/582 X 4,199,907 4/1980 Bains et al. ..... 52/584 X 4,251,969 2/1981 Bains ..... 52/584

*Primary Examiner*—Price C. Faw, Jr.

*Assistant Examiner*—Carl D. Friedman

*Attorney, Agent, or Firm*—Lane, Aitken, Kice & Kananen

[57] ABSTRACT

In a window lining, the corner between two adjoining lining plates is tightened by a wedge effect provided by engagement between a displaceable rail on the first plate and a rail fixed on the second plate. After the mounting of said second plate, the first plate can be brought into its place adjacent the fixed rail and can be tightened by hammer strokes which may be transmitted to the end of the displaceable rail via a flat mandrel so that the gap between the lining and the wall surrounding the window opening may be correspondingly narrow.

4 Claims, 4 Drawing Figures

WINDOW LINING ARRANGEMENT, PARTICULARLY FOR INCLINED WINDOWS

Figure 1:
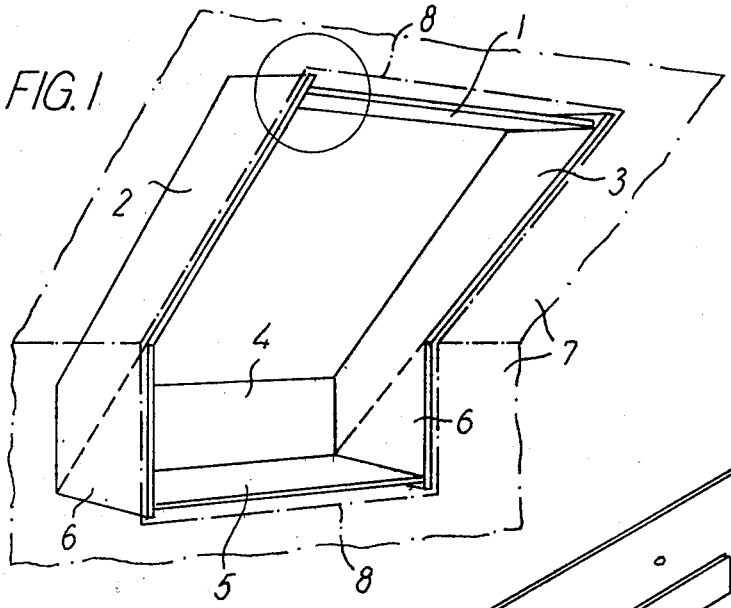

In the mounting or installation of windows, especially inclined skylights for living rooms, the inner linings demand considerable adaption and assembling work on the site. This work is normally carried out after the inside of the window mounting wall has been made ready for painting or papering, and the installation work is finished by applying border lists which cover the front or inner edge of the lining and the gap between the lining and the adjacent edge of the inside of the wall.

When, as is usually the case, it is desired to use narrow border lists, the gap must be correspondingly narrow so that in practice it does not leave room for carrying out operations on the outside of the lining, i.e. between the latter and the wall, with a view to assembling the lining and fastening it to the window frame. However, at the same time it is normally demanded that these operations should not leave noticeable traces in the finished window, such as visible assembly fittings, and this demand is often fulfilled in the way that the lining plates, after adaption and marking-off, are assembled to form a box-shaped frame, which is then inserted in the window opening of the wall and is fastened to the window frame by gluing, usually in connection with a tongue and groove connection.

Especially when relatively large windows are concerned, this conventional way of installation requires considerable technical skill and care, and the costs of the manual work become correspondingly high, also because it may be difficult or impossible for one person alone to lift the lining frame into its place.

When considering this prior art as the starting point, the invention relates to a window lining arrangement, particularly but not exclusively for inclined windows, which in a known manner is composed of plate members that are connected to form a box-shaped frame, one edge portion of which is fastened to the window frame while its other edge is level with the inside of the wall in which the window is installed, and where an end edge of the first one of two lining plates adjoining in a corner closely abuts on the inside of the second plate.

A purpose of the invention is to facilitate and reduce the price of the assembling and mounting of such a lining, and this is obtained in the way that said second plate extends beyond the end edge of the first plate and on the inside of the extended portion carries a fixed angle rail, the projecting flange of which forms an outer abutment for the end edge portion of the first plate, and that said first plate at its end edge carries a displaceable rail comprising a flap for engagement behind a flap on the projecting flange of the fixed rail, said displaceable rail being guided in such a manner that a displacement of the rail along its longitudinal axis causes the plates to be tightened against each other.

As will appear more detailed from the following description, the plate members of the lining can in this case be adapted and mounted successively so that they are first assembled to form the box-shaped form as the mounting gradually proceeds. The work can hereby be managed by one person alone, even in the case of large windows, and it will also be easier to obtain a precise adaption of each plate because the marking-off of and possibly the measurements for a plate to be mounted can be based on one or more plates which have already been correctly mounted. A special advantage is that the rails referred to permit very firm corner connections to be obtained because the displaceable rails may be forced into place. This operation requires just a modest gap width between lining and wall, since space is only required for the insertion of a screwdriver or another thin or slender instrument, which like a mandrel is able to transfer hammer strokes to the rail.

Figure 3:
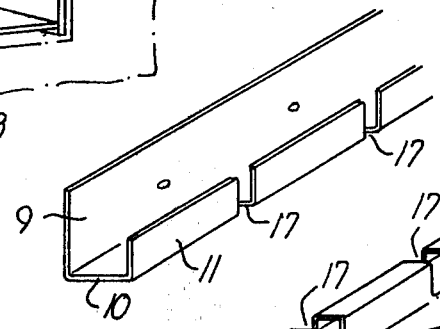
Figure 3:
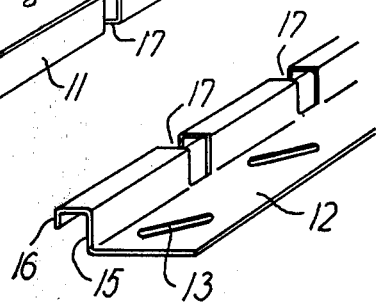
Figure 2:
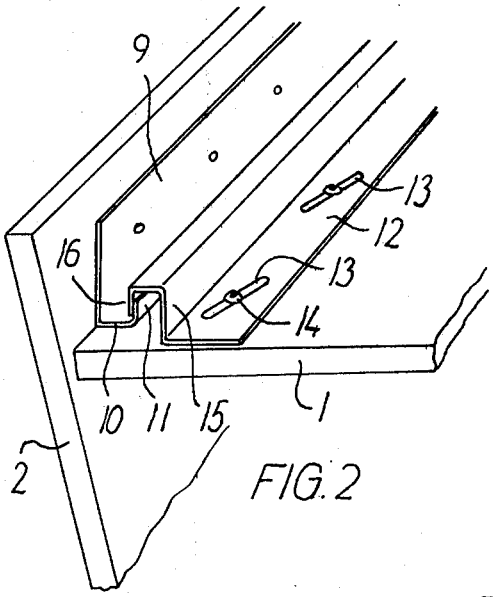
Figure 4:
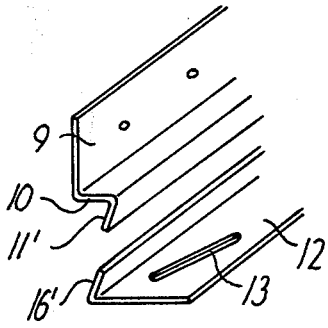

An embodiment of the lining arrangement according to the invention is illustrated on the drawing, in which FIG. 1 shows the finished lining for an inclined window with parts of the surrounding wall being indicated in dotted lines, the window itself being left out, FIG. 2 shows the corner portion marked with a circle in FIG. 1 in a different perspective and in greater scale, and FIGS. 3 and 4 show portions of a pair of cognate tightening rails in modified embodiments.

The lining shown in FIG. 1 consists in an ordinary manner of a top plate 1, two side plates 2 and 3, a vertical lower plate 4 and a shelf or window plate 5. In a lining for a vertical window the vertical lower plate 4 will usually be left out, and this also applies to the triangular plates 6 indicated as separate portions of the side plates 2 and 3.

The plate members 1 to 6 can be delivered with a finished surface and in suitable overmeasure, the final adaption being usually made on the site after the installation of the window and finishing of the inside of the wall 7 with the window opening 8, indicated in dotted lines.

The installation of the lining can be started by adapting the length and the width (or depth) of the side members 2 and 3 and marking-off the positions thereon of the top plate 1, the lower plate 4, and the shelf 5, which with their end edges should fit closely to the insides of the side plates 2 and 3. In accordance with the marking-off, L-shaped mounting rails are then fastened to the inside of the side plates 2 and 3 above the top plate 1, behind the lower plate 4 and below the shelf 5. FIG. 2 shows such a rail 9 for the upper left corner of the lining and it is seen that the projecting flange 10 of this rail forms an abutment for the upper or the outer surface of the top plate 1 and continues in an upstanding flap 11. When the several rails 9 have been fastened the side plates 2 and 3 are inserted in the window opening and are fixed to the window frame, not shown, conveniently by means of angle fittings which are so placed that they will later on be hidden by the members 1, 4, and 5.

These elements or plate members can thereafter be adapted as relates their length and width (or depth) and be equipped with displaceable rails 12 as shown in FIG. 2. In the embodiment shown, these rails include a flange with inclined slots 13 which diverge from the end edge of the plate member, reckoned from the inner edge towards the outer edge of the lining, and each slot receives the shank of a screw 14 sitting in the top plate 1. At its side nearest to the end edge of the plate 1, the flange of the rail continues in an upstanding portion or flange 15 having a downwardly directed flap 16 engaging behind the flap 11 of the rail 9 fixed on the side plate 2.

After the mounting of such a rail 12 at each end of the top plate 1, this plate can be pushed into its place along the associated rails 9 on the side plates 2 and 3 and can then be tightened thereto by the rails 12 being forced inwards along their longitudinal axes, towards the window frame by hammer strokes on their front ends until wedging has taken place. Usually, the gap between the plate 1 and the edge 8 of the wall does not leave sufficient place for a hammer-head to pass but in such case, as mentioned above, an appropriate mandrel can be used.

The lower plate 4 and the shelf 5 can be mounted successively in an analogous manner, except that the displaceable rails 12 belonging to the lower plate are forced upwards.

The length of the rails 9 and 12 should preferably correspond approximately to the lengths of the corners of the lining but must always end in or behind the plane of the inside of the wall 7, so that they can be covered by ordinary border lists. To facilitate the adaptation of the length of the rails, these rails may, as shown in FIG. 3, be provided with appropriately spaced notches 17 as a preparation for division.

In the modification shown in FIG. 4, the direction of the engaging flaps is reversed as compared with FIGS. 2 and 3, the projecting flange 10 of the fixed angle rail 9 being provided with a generally downwardly directed flap 11', the angle of which with the flange, however, is somewhat less than 90°, whereas the displaceable rail 12 has an upstanding flap 16' with the same bevel. In this case the mounting can take place in exactly the same manner as explained above, except that the plate with the displaceable rail 12 need not be pushed into its place since the edges of the two flaps 11' and 16' are able to pass each other in the outer extreme position of the rail 12.

I claim:

1. A window lining arrangement, particularly for inclined windows, composed of plates which are connected to form a box-shaped form, one edge portion of which is fastened to the window frame while its other edge is level with the inside of the wall in which the window is installed, and where an end edge of a first one of two plates adjoining in a corner closely abuts on the inside of the second plate, characterized in that said second plate extends beyond the end edge of the first plate and, on the inside of the extended portion, carries a fixed angle rail having a projecting flange which forms an outer abutment for the end edge portion of the first plate, and said first plate at its end edge carries a displaceable rail comprising a first flap for engagement behind a second flap on the projecting flange of the fixed rail, said displaceable rail being guided in such a manner that a displacement of the displaceable rail along its longitudinal axis causes the plates to be tightened against each other.

2. A window lining as claimed in claim 1, characterized in that the displaceable rail is connected to said first plate by means of screws passing through inclined slots in a flange of the displaceable rail, the direction of said slots diverging from the first flap of the displaceable rail.

3. A window lining as claimed in claim 1 or claim 2, characterized in that the projecting flange of the fixed angle rail forms an abutment for the outside of the first plate and the second flap is spaced from the second plate, the displaceable rail being provided with an upstanding portion extending across the second flap and carrying the first flap engaging therebehind.

4. A window lining as claimed in claim 1 or claim 2, characterized in that the second flap points toward the outside of the first plate, said second flap forming an angle of somewhat less than 90° with the flange, and that the first flap has approximately the same bevel.

* * * * *